United States Patent [19]

Jablonski et al.

[11] 4,127,976

[45] Dec. 5, 1978

[54] METHOD AND APPARATUS FOR MAKING DUAL COMPARTMENT CONTAINERS

[75] Inventors: Charles E. Jablonski; John W. Kreiger, both of Bethlehem, Pa.

[73] Assignee: Atlas Powder Company, Dallas, Tex.

[21] Appl. No.: 827,154

[22] Filed: Aug. 24, 1977

[51] Int. Cl.[2] ..... B65B 9/12; B65B 57/14

[52] U.S. Cl. ..... 53/450; 53/493; 53/551

[58] Field of Search ..... 53/28, 59 R, 180 M, 53/182 M; 417/22, 42, 43, 46, 47, 53

[56] References Cited

U.S. PATENT DOCUMENTS

| | | | |
|---|---|---|---|
| 2,749,842 | 6/1956 | Angell et al. | 417/42 |
| 3,617,151 | 11/1971 | Scroggins | 417/42 X |
| 3,992,854 | 11/1976 | Howell et al. | 53/14 |
| 4,023,327 | 5/1977 | Simmons | 53/180 M |
| 4,060,736 | 11/1977 | Conners | 53/59 R |

*Primary Examiner*—Robert Louis Spruill

*Attorney, Agent, or Firm*—Richards, Harris & Medlock

[57] ABSTRACT

Method and apparatus for producing dual compartmented tubular containers which includes a system for pumping a high viscosity fluid at a constant flow rate and includes an air driven pump for pumping the fluid from a storage location to an output point. The pump is of the type which produces a substantially constant output per pump cycle. The pump is driven by an air supply communicating with the pump. A timer is attached to the output pump shaft and measures the cycle speed of the pump. The air pressure driving the pump is varied in response to the cycle speed of the pump to maintain the speed of the pump constant. Whenever the material being driven by the pump increases in viscosity, a slow down in the pump speed is prevented by increasing the air pressure used to drive the pump. Where the viscosity decreases and the pump speed begins to increase, the air pressure used to drive the pump is decreased to maintain a constant pump speed.

2 Claims, 2 Drawing Figures

METHOD AND APPARATUS FOR MAKING DUAL COMPARTMENT CONTAINERS

FIELD OF THE INVENTION

This invention relates to an apparatus and method for producing a steady flow of viscous fluids.

BACKGROUND OF THE INVENTION

Prior Art

Many fluids, known as non-newtonian fluids, do not have uniform flow properties. These fluids change viscosity depending upon the shear stresses acting on them. The fluids may be less viscous at high flow rates, but increase in viscosity after they have been allowed to set. Therefore, providing a steady state flow of these fluids has long been a problem.

Providing a uniform flow rate of these fluids is often critical. For example, it has become the practice to automatically and continuously load curable polyester resin and a catalyst in distinct compartments formed in a flexible tubular container. These containers of material are produced by forming a continuous length of the dual compartments from a flexible material, loading the polyester resin and catalyst into the separate compartments, and dividing the continuously formed compartments filled with the components into predetermined packages containing the components. These packages are produced on a continuous basis with the polyester resin and the catalyst being injected continuously as the flexible material is formed into the suitable compartments for receiving the material. As many as 1500 such containers are produced per hour.

Although the components are continuously loaded into the compartments of the container, the viscosity of the material may change in response to temperature changes or product consistency. Moreover, because the polyester resin is normally mixed with filler and thixotropic components, the viscosity may vary from production to production. However, in order for each package to be identical in size and firmness, one to the other, an equal volume of material must be loaded into each capsule. Because the container in which the material is loaded is drawn through the process at a constant rate, and severed at constant time intervals, the package itself remains uniform in length. Thus, in order for the final product to be uniform, the pumping system for delivering the polyester resin composition must be capable of producing a uniform quantity of material per unit of time. An irregular supply of the components will result in varying firmness among the packages and thus effect the functionality of the product.

Heretofore, gear pumps and screw pumps have been suggested as appropriate in providing a steady state flow of highly viscous fluids. However, where the fluid viscosity reaches levels of 100,000 centipoise, these types of pumps have been found to be completely unsatisfactory. Both the gear pumps and screw pumps have been found to bind up and fail after very short periods of pumping. Where air driven pumps have been used, they have not by themselves been capable of providing the steady state flow of materials required to produce a uniform product.

SUMMARY OF THE INVENTION

The present invention provides a system for pumping a high viscosity fluid at a constant flow rate. The system includes an air driven pump for pumping the fluid from a storage location to an output point. The pump is of the type which produces a substantially constant output per pump cycle. The pump is driven by an air supply in communication with the pump. A timer is attached to the output pump shaft and measures the cycle speed of the pump. The air pressure driving the pump is varied in response to the cycle speed of the pump to maintain the speed of the pump constant. Thus, whenever the material being driven by the pump increases in viscosity, due to changes in the ambient temperature or product consistency, a slow down in the pump speed is counteracted by increasing the air pressure used to drive the air pump. Where the viscosity decreases and the pump speed begins to increase, the air pressure used to drive the pump is decreased to maintain a constant pump speed.

The system of the present invention finds its most ready application in providing highly viscous polyester resin grout to a system for making dual compartmented containers. The pumping system provides resin grout for loading into one compartment, with a second fluid being supplied by a separate system to the second compartment. In these systems, the compartmented containers are made continuously with the present invention providing a continuous even volumetric flow of the viscous polyester resin grout required in the packaging process.

BRIEF DESCRIPTION OF THE DRAWINGS

For a more complete understanding of the present invention, and for further details and advantages thereof, reference is now made to the following description taken in conjunction with the accompanying drawings, in which.

DESCRIPTION OF THE PREFERRED EMBODIMENT

In a preferred embodiment of the present invention, a pumping system embodying the present invention is used to supply polyester resin grout to an apparatus for continuously forming dual compartmented containers with one compartment filled with the resin grout and the second adjacent container filled with an appropriate catalyst. An example of such a product is disclosed in U.S. Pat. No. 4,009,778 to Howell, issued Mar. 1, 1977, and the machine for producing the containers in U.S. Pat. No. 3,992,854 to Howell et al, issued Nov. 23, 1976, these disclosures being incorporated herein by reference.

Figure 1:
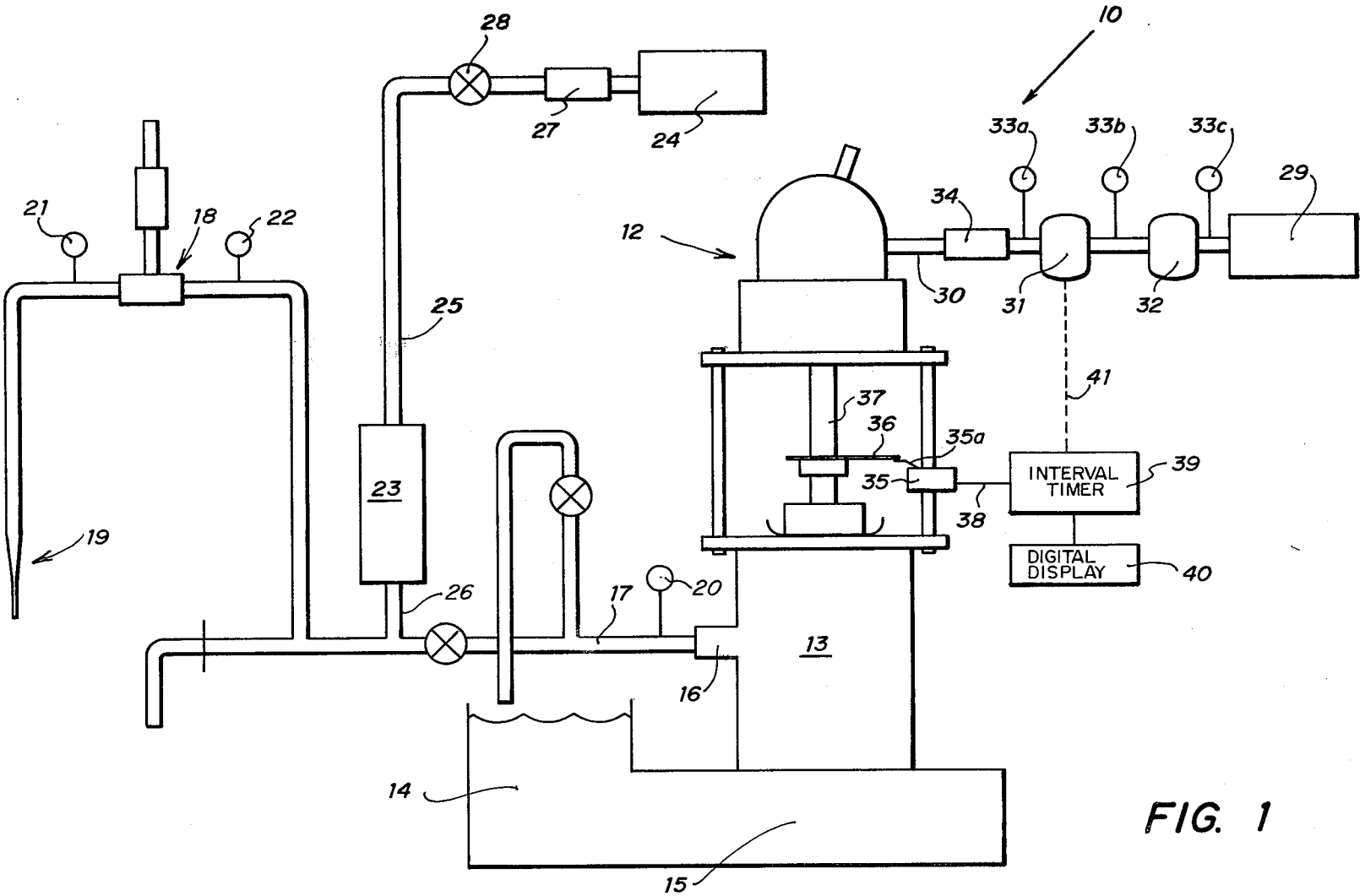
FIG. 1 is a schematic view of the pumping system of the present invention.

Referring to FIG. 1, the pumping system 10 of the present invention supplies polyester resin grout to an apparatus 11 (FIG. 2) for continuously forming and filling a compartmented package which is later severed into unitary containers with the resin grout in one compartment and a catalyst in an adjacent compartment. The system 10 includes a piston drive air pump 12 with the pump piston (not shown) in a lower chamber 13. A resin grout holding tank 14 supplies premixed resin grouting to a manifold 15 in communication with chamber 13 of air pump 12. Chamber 13 has an output port 16 which communicates through an output line 17 to a controlled shutoff valve 18. A resin grout supply line 19 is attached to valve 18 opposite line 17. A suitable pressure gauge 20 is positioned on the output side of port 16 and similar gauges 21 and 22 are positioned on each side of shutoff valve 18. An accumulator 23 is connected between a high pressure nitrogen supply 24 and line 17 by suitable tubing 25 and 26, respectively. A check valve 27 and a manual valve 28 are positioned in the flow path of line 25.

Air pump 12 is driven by air pressure supply 29 connected thereto by an appropriate line 30. Control regulators 31 and 32 are attached along line 30. Likewise, pressure gauges 33*a*, 33*b* and 33*c* are connected alternately between air pressure supply 29, control regulators 31 and 32 and air pump 12. A solenoid valve 34 is connected between gauge 33*a* and the air pump 12.

A microswitch 35 is attached to the pump superstructure with a contact 35*a* extending in the path of an arm 36 which moves with pump shaft 37. Microswitch 35 is connected by line 38 to an interval timer 39 which measures the time between a full stroke of pump shaft 37 and thus the time per cycle of the pump's operation. A digital display 40 is connected to interval timer 39 to provide a digital readout of the lapse time per cycle of the air pump.

A control, either manual or automatic, is indicated by the dotted line 41 between the interval timer 39 and the control regulator 31, the operation of which will be discussed hereafter in greater detail.

Air pump 12 is of the type which uses pressurized air to drive a driving piston for operation of shaft 37 to oscillate a pump piston in chamber 13 for pumping fluid from manifold 15 through pump outlet 16. For all practical purposes, the fluid volume driven by the air pump per cycle can be considered constant. However, because the pump is driven by air pressure, the viscosity of the fluid being pumped will effect the elapsed time between pump cycles. For instance, where the viscosity of the fluid being pumped changes 10 percent, the time required for the pump to complete one cycle will be varied almost proportionally. The viscosity of the fluid being pumped may be effected by many parameters. The temperature of the substance naturally will effect the viscosity, with a 1° F. temperature variation capable of changing viscosity by as much as 10 percent. Also, the viscosity of the fluid may vary from one batch of material to the next and also in response to the particular speed at which the pump is operating.

The air pump characteristically produces a sinusoidal output flow with the peak flow naturally corresponding to the outstroke of the pump. In order to normalize this variable output, accumulator 23 is attached to output line 17. In its operation, pressurized nitrogen gas is communicated to the accumulator 23 from supply 24 and provides a cushion against which the variable output of the air pump may act. Thus, at the peak output, some of the fluid will be forced into accumulator 23 and act against the pressure communicated thereto by nitrogen supply 24. As the output pressure of the pump decreases, material is supplied from accumulator 23 into line 17 to be discharged through supply line 19. In this way, a more even supply of fluid is provided from the air pump. Additionally, the pumping of a high viscosity fluid also tends to normalize or even out the flow of fluid provided through the pump.

The present invention includes an interval timer 39 which provides to the operator the elapsed time between each pump cycle. When the pump and system to which the pump is supplying resin grout has been set in steady state operation, the interval timer provides an indication of the pump speed which must be maintained in order to provide a desired rate of flow of material to the packaging machine. If this interval time increases, as a result of increasing viscosity of the fluid, or decreases, as a result of the decrease of viscosity of the fluid, the operator is notified that the air pressure used to drive the air pump must be varied, either to increase the operation of the pump or decrease the operation of the pump. This control, indicated by the dotted line 41, may be manual or automatic.

Thus, the present invention provides a system in which an air pump may be used to drive a highly viscous or non-newtonian fluid to a packaging apparatus and provide an operator with a visual indication of the cyclic speed of the pump's operation. Once a desired speed has been obtained, the timer indicates to the operator when the speed has been altered as a result of the change in viscosity or other changing parameters in the system. By adjusting the air pressure to the air pump, the speed may be regained in order to provide a steady state flow of material to the packaging apparatus.

Figure 2:
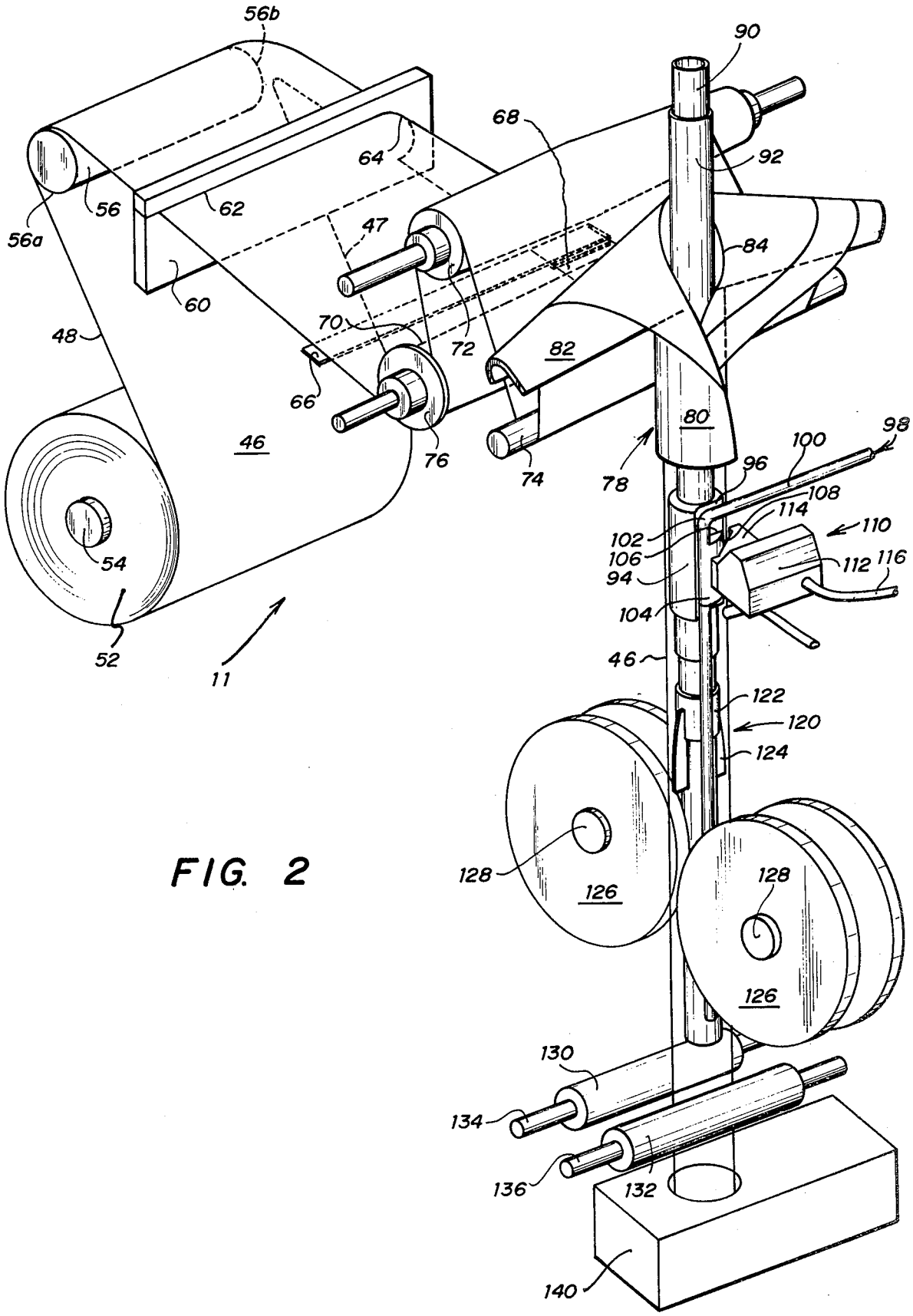
FIG. 2 is a perspective view of an apparatus receiving viscous material from the pumping system of the present invention.

Referring to FIG. 2, the pumping system of the present invention is ideally suited for providing resin grout to the apparatus 11 for producing compartmented containers for receiving the resin grout and a suitable reactor catalyst therein. In the operation of apparatus 11, film material 46, having longitudinal edges 47 and 48, is supplied from a drum 52 which is rotated on an axis shaft 54. Film material 46 is directed around a roller 56 with end 56*a* aligned with edge 48 of film material 46. Roller 56 is slightly shorter in length than the width of film material 46 such that end 56*b* of roller 56 is positioned slightly inside of edge 47 of film material 46. Because of this positioning of roller 56, as film material moves over the roller edge 47 begins to turn under. Film material 46 is directed through a folding guide 60 having a slot 62 with a curved end 64 therein. As film material 46 is directed through guide 60, edge 47 is folded under the adjacent portion of the material. Film material 46 is then directed through folder 66 which completes the folding of edge 47 and a side portion of the material under the remainder of the material to form a two-ply margin 68.

Material 46, with two-ply margin 68 formed along one side thereof, is wrapped in a serpentine path around three crown rollers 70, 72, and 74. Circular discs 76 are attached near each end of crown roller 70 to limit the movement of film material 46 from side-to-side on the roller. As film material 46 comes off of roller 74, it is carried over a film folder 78 which includes a neck 80 supporting a pair of forming shoulders 82. Neck 80 is an incomplete cylinder with its front ends overlapping each other. Neck 80 joins forming shoulders 82 to form an oval intersection 84. Oval intersection 84 has its apex at the upper back of shoulders 82 and curves downwardly and forwardly to the front of neck 80 where each end of the intersection 84 overlaps the other as the front ends of neck 80 overlap.

Film material is drawn over shoulders 82 and directed into neck 80 with the middle of the film material being drawn into the interior of neck 80 first. Film material 46 is formed into a cylinder shape with margin 68 underlying edge 48 of the film material. Thus, the double-ply margin 68 is positioned interiorally of edge 47 of film material 46.

A polyester resin supply tube 90 is supported through the opening formed by neck 80. A tapered stiffener 92 is attached at the upper end of tube 90 with its lower end extending partially into the opening formed by neck 80. A forming anvil 94 is attached immediately below neck 80 to supply tube 90. Anvil 94 generally has a circular upper section but with a portion removed to form a flat surface 96. A catalyst mandrel 98 includes a supply tube 100 and a fin 104 attached to tube 100 below elbow 102. Catalyst mandrel 98 is supported adjacent anvil 94. Tube 100 and fin 104 together form an airfoil-shaped structure with a flat surface 106 slightly spaced from but substantially parallel to flat surface 96 of anvil 94. The surface 108 of fin 104 opposite surface 106 is slightly curved with the same radius as the circular portion of anvil 94 and is positioned coincident with the continuation of the circumference of anvil 94. Thus, anvil 94 and tube 100 and fin 104 form a cylindrical support for film material 46 as it is wrapped into a tubular configuration by folder 78 and passes out of neck 80.

A sealer unit 110 including a heater unit 112, a directional nozzle 114 and an air inlet supply 116 is supported immediately below elbow 102 of tube 100 and in close proximity to anvil 94 and catalyst mandrel 98. Sealer unit 110 operates to seal film material 46 into the dual compartmented container, the subject of the present invention.

As the film material passes out of neck 80, edge 48 is directed to the outside of tube 100 as is the outer layer of margin 68. The inner layer of margin 68 is directed to the inside of tube 100 and fin 104 such that the catalyst supply tube 100 is sandwiched between the inner and outer layers of margin 68. Immediately below the lower end of neck 80, edge 47 is sealed to the film material therebelow to form a first compartment. Simultaneously therewith, edge 48 is sealed to the outer layer of margin 68 to form a second compartment.

A film spreader 120 is attached to tube 90 below sealer unit 110. Film spreader 120 includes a tubular collar 122 having a pair of opposed wings 124 extending radially therefrom. Wings 124 elongate film material 46 as it passes therepast to allow drive rollers 126 to pinch the film material therebetween and draw the sealed tube downwardly past the lower ends of resin supply tube 90 and catalyst tube 100. Film drive rollers 126 are supported for rotation on axis 128.

Below the sealer unit, the film material has been sealed into a dual compartmented container. Polyester resin is then loaded into the larger compartment as the container passes the lower end of resin supply tube 90, and a catalyst is supplied to the smaller compartment as the container passes the lower end of catalyst supply tube 100.

A pair of void rollers 130 and 132 are supported for rotation on shafts 134 and 136, respectively, on opposite sides of the filled container below film drive rollers 126. The void rollers 130 and 132 are synchronized to move inwardly against the filled container to void spaced sections along the container as it is moved through the unit. As this void passes into a clamping unit 140, the voided area is sequentially gathered together, and a pair of suitable clips bound therearound. The tube is then severed between the clips to produce containers filled with the resin grout pumped by pumping system 10 and a suitable catalyst.

Although preferred embodiments of the invention have been described in the foregoing detailed description and illustrated in the accompanying drawings, it will be understood that the invention is not limited to the embodiments disclosed, but is capable of numerous rearrangements, modifications and substitutions of parts and elements without departing from the spirit of the invention. The present invention is therefore intended to encompass such rearrangements, modifications and substitutions of parts and elements as fall within the scope of the appended claims.

What is claimed is:

1. In an apparatus for making a dual compartmented container and loading a high viscosity fluid which is subject to fluctuations in viscosity in one compartment and a second fluid in the second compartment, the apparatus comprising:

means for directing a continuous web of pliable material having first and second longitudinal edges to a forming anvil, means for folding the first edge of said web onto the remainder of said web to form a two-ply side portion, means for forming said web into a continuous tube with the overlying flap of the two-ply portion facing outwardly and with the second edge of said web overlying the side portion, means for attaching the first edge of said web to the web adjacent therebelow forming a first compartment and for attaching the second edge of said web to the outer layer of the two-ply margin along a second seam to form a dual compartmented tube from said web, an air driven pump for pumping a high viscosity fluid from a storage location into said second compartment, an air supply communicating with said pump to drive said pump, a timer for measuring the cycle speed of said pump, means for varying the pressure from said air supply to said pump in response to changes in cycle speed occasioned by fluctuations in viscosity of said high viscosity fluid to thereby maintain a constant output of said high viscosity fluid, means for loading a second fluid into said first compartment, and means for gathering and sealing the compartments at spaced lengths along the longitudinal lengths thereof.

2. In a system for making a dual compartmented container and loading a high viscosity fluid, which is subject to fluctuations in viscosity, in one compartment, the method comprising:

feeding a continuous sheet of material having first and second longitudinal edges toward an anvil, folding the first edge of the sheet onto the sheet of material to form a double layer margin, guiding the sheet around the anvil overlapping the second edge over the double layer margin, directing the sheet past a second mandrel with the second mandrel positioned between the layers of the double layer margin, attaching the first edge of the sheet to the sheet therebelow to form a first compartment, attaching the second sheet of the sheet to the outer layer of the double layer margin forming a second compartment, pumping said high viscosity fluid from a storage unit into said first compartment, timing the lapsed time between the pump cycles, varying the air pressure used to drive the pump in accordance with changes in the cycle speed occasioned by fluctuations in the viscosity of said high viscosity fluid to thereby maintain a constant output of said high viscosity fluid, loading a second fluid into said first compartment, and gathering and sealing the compartments at spaced lengths along the longitudinal lengths thereof.

* * * * *